United States Patent [19]

Taubert et al.

[11] 4,074,518

[45] Feb. 21, 1978

[54] APPARATUS FOR MAKING A LINK-TYPE CONVEYOR BELT

[75] Inventors: Klaus Taubert, Herkersdorf; Reimund Benner; Friedrich Judt, both of Eiserfeld, all of Germany

[73] Assignee: Meyer, Roth & Pastor Maschinenfabrik GmbH, Cologne, Germany

[21] Appl. No.: 742,202

[22] Filed: Nov. 15, 1976

[30] Foreign Application Priority Data

Nov. 15, 1975 Germany ..... 2551453

[51] Int. Cl.[2] ..... B21L 11/02

[52] U.S. Cl. ..... 59/15; 59/35 CP; 59/91

[58] Field of Search ..... 59/35, 6, 12, 13, 14, 59/15, 91; 198/853; 29/11

[56] References Cited

U.S. PATENT DOCUMENTS

| | | | |
|---|---|---|---|
| 461,268 | 10/1891 | McCool | 59/6 |
| 462,238 | 11/1891 | Corscaden | 29/11 |
| 2,660,292 | 11/1953 | Cheesman | 59/15 |
| 3,514,941 | 6/1970 | Mueller | 59/35 |
| 3,706,200 | 12/1972 | Mueller | 59/35 |
| 3,868,011 | 2/1975 | Janzen | 59/91 |
| 3,871,314 | 3/1975 | Stargell | 113/121 C |

*Primary Examiner*—C.W. Lanham
*Assistant Examiner*—Gene P. Crosby
*Attorney, Agent, or Firm*—Spencer & Kaye

[57] ABSTRACT

An apparatus for making a link-type belt formed of a plurality of plate members by punching out planar plate members from a sheet metal, wherein each plate member has lateral portions projecting outwardly from two opposite sides of the plate member; prebending the free end of each lateral portion; bending each lateral portion into an orientation substantially perpendicular to the respective plate member; rolling-in each lateral portion for forming hinge eyes on each plate member; aligning the plate members with one another; and inserting a hinge bolt into aligned hinge eyes of adjoining plate members.

4 Claims, 8 Drawing Figures

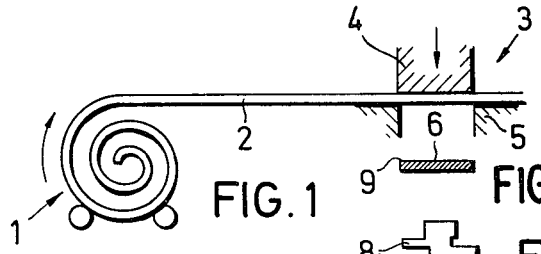
FIG. 1
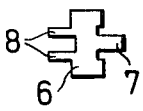
FIG. 2a
FIG. 2
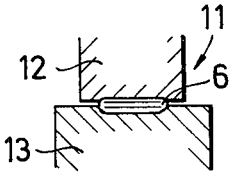
FIG. 3
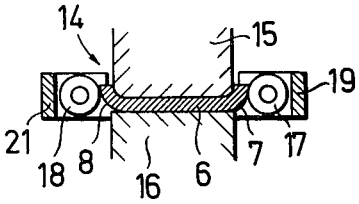
FIG. 4
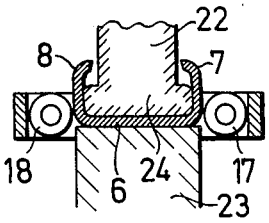
FIG. 5
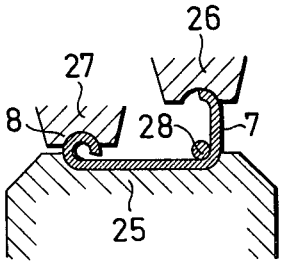
FIG. 6
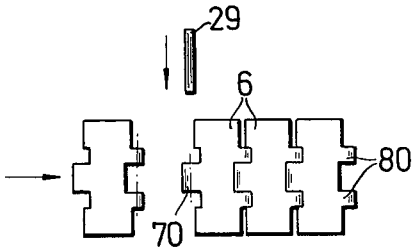
FIG. 7

APPARATUS FOR MAKING A LINK-TYPE CONVEYOR BELT

BACKGROUND OF THE INVENTION

The invention relates to a method for making a link-type conveyor belt from a plurality of plate members which are linked together by means of hinge eyes and hinge bolts and which are each cut out of a flat strip of cut sheet metal and on which subsequently the hinge eyes are formed.

Link-type conveyor belts of the above-mentioned type serve as conveying means, for example to transport goods made of glass, paper, metal and plastic, particularly bottles and jars. Due to the articulated, hinge-like connection of the plate members such link-type conveyor belts can also be guided around curves. Generally the known plate members each have one hinge eye on one longitudinal side and on the respective opposite longitudinal side they have two hinge eyes which are spaced from one another in such a manner that the center hinge eye of the respective adjacent plate member is accommodated therebetween. The row of plate members is linked together by hinge bolts which are inserted into the hinge eyes.

In a German Published Pat. application No. 2,237,600 there is disclosed a link-type conveyor belt in which after cutting out the individual plate members from a strip of sheet metal, a tongue disposed at one longitudinal side of each plate member is rolled inwardly to form the center hinge eye. At the same time strips disposed at the other side of the plate member are rolled inwardly to form the two outer hinge eyes. In the this known process the plate members are put aside after cutting, bending and rolling, i.e. after every process step, so that complicated manipulations are required and handling delays result which considerably increase the manufacturing time for the link-type conveyor belts.

SUMMARY OF THE INVENTION

It is an object of the invention to provide a simple economical fully automatic process for making a link-type conveyor belt from a plurality of plate members which are linked together via hinge eyes and hinge belts.

This object and others to become apparent as the specification progresses, are accomplished by the invention, according to which, briefly stated, the method of making a link-type belt formed of a plurality of plate members comprises the consecutive steps of punching out planar plate members from a sheet metal, wherein each plate member has lateral portions projecting outwardly from two opposite sides of the plate member; prebending the free end of each lateral portion; bending each lateral portion into an orientation substantially perpendicular to the respective plate member; rolling-in each lateral portion for forming hinge eyes on each plate member; aligning the plate members with one another; and inserting a hinge bolt into aligned hinge eyes of adjoining plate members.

In this way the required individual steps can be effected one after the other within the shortest possible time and without interruption. The process can be effected without difficulty so that link-type conveyor belts of certain lengths can be produced fully automatically. The particular significance of the invention lies in the interlacing of the individual operations. This results in a substantial saving of time during manufacture of the link-type conveyor belts in question.

It is a further feature of the invention that the hinge eye parts are all prebent and/or bent upright or rolled in, respectively, simultaneously. In particular, the simultaneous prebending or bending upright, respectively, of the plate portions disposed on opposite sides of the plate members results in extremely simple and easy manufacture of the hinge eyes.

Advantageously the plate members are stamped before the plate portions are prebent. In this way all burrs remaining from the cutting process can be removed and at the same time a certain aligning can take place so that all plate members are in substantially the same state for prebending of the hinge eyes. This has a particularly favorable effect on the quality of the hinge eyes.

BRIEF DESCRIPTION OF THE DRAWINGS

FIG. 1 is a schematic side elevational view of an arrangement for the stamping of the plate members out of a cut sheet metal strip.

FIG. 2 is a top plan view of a cut-out plate member.

FIG. 2*a* is a longitudinal sectional view of a cut-out plate member.

FIG. 3 is a schematic side elevational view of an arrangement for the shaping of a plate member.

FIG. 4 is a schematic side elevational view of an arrangement for the prebending of the plate portions forming the hinge eyes.

FIG. 5 is a schematic side elevational view of an arrangement for the upright bending of the plate portions forming the hinge eyes.

FIG. 6 is a schematic side elevational view of an arrangement for the rolling in of the hinge eyes.

FIG. 7 is a top plan view illustrating the linking together of the individual plate members to form a link-type conveyor belt.

DESCRIPTION OF THE PREFERRED EMBODIMENT

As can be seen in FIG. 1, a metal strip 2 runs from a supply reel 1 to a punching device 3. This punching device substantially includes a punch 4 and a matrix 5. By means of punching device 3 plate members (blanks) 6 are punched out in sequence of the sheet metal strip 2. As seen in FIG. 2, which show a plate member 6 in top plan view, the plate members 6 are provided with portions 7 and 8 on oppositely disposed longitudinal sides in order to form in subsequent operational steps described below a center hinge eye and two spaced hinge eyes.

Together with the punching, the plate members 6 are marked in punching device 3. FIG. 2*a* shows that a burr 9 remaining from the punching process is disposed at the upper peripheral edge.

In a second process step, as shown in FIG. 3, plate member 6 is calibrated in a calibrating press 11 which likewise includes a punch 12 and a matrix 13, so that the burr 9 remaining from the punching step is removed. At the same time the calibrating press 11 gives the plate member the desired outline and thus aligns the plate member.

Following the calibration process, the plate member 6 is brought into a bending press 14 shown in FIG. 4 which includes a ram 15 and a backup or ejector 16, as the case may be. In order to prebend the plate portions 7 or 8, respectively, plate member 6 is brought between the stamp and the backup 16 and then ram 15 is lowered. The outside of plate portions 7 and 8 is supported by bending rollers 17, 18 mounted in a supporting member 19, 21.

Plate member 6 with plate portions 7 and 8 which have been bent upwardly in the above described manner are then moved to a further station of the bending press (FIG. 5) which includes a special ram 22 and backup or ejector 23, as the case may be. Ram 22 has a thickened head 24 which is designed so that when ram 22 is lowered toward backup 23 the prebent plate portions 7 and 8 are bent substantially vertically upright to be thus oriented essentially prependiculary with respect to the bottom surface of plate member 6. Plate member 6 remains supported by bending rollers 17 and 18 at its plate portions 7 and 8. After ram 22 has been raised, plate member 6 is removed from ram 22 by grippers attached at the sides and not shown and is transported to the next stage.

The plate member is then placed onto a lowered anvil 25 which is shown in FIG. 6 and which cooperates with rolling dies 26, 27 to complete the rolling in of plate members 7 and 8. In FIG. 6 the left rolling die 27 is shown in its closed state where plate portion 8 has been completely rolled into a hinge while the right rolling die 26 is shown in the open position. In order to complete rolling of plate portion 7 the rolling die 26 must be moved downwardly. This causes plate portion 7 to be rolled about a rolling mandrel 28 to correspond to plate portion 8.

FIG. 7 shows that plate members 6 have been aligned to form a link-type conveyor belt. In order to link the individual plate members 6 together, a hinge bolt 29 is inserted from the side into each one of the hinges 70, 80 formed of plate portions 7, 8. The link-type conveyor belt completed in this manner is brought to a testing station and is there tested for operability in an automatic run.

The method according to the invention for making a link-type conveyor belt makes it possible to completely assemble in a total of six process steps a link-type conveyor belt consisting of individual plate members 6 which have been stamped out of a flat strip of sheet metal.

The lowered anvil need not be equipped with two separately movable rolling dies 26, 27 to roll in plate portions 7 and 8; rather it is possible, in principle, to employ a single rolling die with a concave recess to roll in the plate members 7 and 8 disposed at the one and the other side thereof if the recess in the rolling die and the respective plate portion to be bent are aligned with one another which is possible, for example, by appropriately shifting the plate member.

It will be understood that the above description of the present invention is susceptible to various modifications changes and adaptations, and the same are intended to be comprehended within the meaning and range of the equivalents of the appended claims.

What is claimed is:

1. An apparatus for making a link-type belt formed of a plurality of plate members having hinge eyes and linked together by hinge bolts passing through the aligned hinge eyes of adjoining plate members, comprising:

(a) a first bending press means for prebending free ends of lateral portions projecting outwardly from two opposite sides of a planar plate member for providing a prebent part at the terminus of each said lateral portion; said first bending press means including a reciprocating ram; a backup support cooperating with said ram; bending rollers arranged laterally of said ram and said backup support for engaging the free ends of the lateral portions of the plate member held between said ram and said backup support; and means for supporting said bending rollers;

(b) a second bending press means for bending each said lateral portion into an orientation substantially perpendicular to the respective plate member; and (c) an anvil-and-die assembly means for rolling-in each lateral portion for forming hinge eyes on each plate member.

2. An apparatus as defined in claim 1, wherein said second bending press means comprises a reciprocating ram having a thickened head and a backup support cooperating with said ram.

3. An apparatus as defined in claim 1, wherein said anvil-and-die assembly means includes an anvil for supporting the plate member and a rolling die engaging the prebent part of the lateral projection extending substantially perpendicularly to the plate member; said rolling die being movable towards said anvil for rolling-in the lateral projection for forming a hinge eye on the plate member.

4. An apparatus as defined in claim 1, further comprising a shaping die for trimming the plate member to the desired outline.

* * * * *